US007573444B2

(12) United States Patent
Choi et al.

(10) Patent No.: US 7,573,444 B2
(45) Date of Patent: Aug. 11, 2009

(54) LIGHT EMITTING DISPLAY

(75) Inventors: Sang-Moo Choi, Suwon-si (KR); Oh-Kyong Kwon, Seoul (KR)

(73) Assignee: Samsung Mobile Display Co., Ltd., Yongin, Gyunggi-Do (KR)

( * ) Notice: Subject to any disclaimer, the term of this patent is extended or adjusted under 35 U.S.C. 154(b) by 730 days.

(21) Appl. No.: 11/312,545

(22) Filed: Dec. 21, 2005

(65) Prior Publication Data

US 2006/0139259 A1 Jun. 29, 2006

(30) Foreign Application Priority Data

Dec. 24, 2004 (KR) ..... 10-2004-0112525
Dec. 24, 2004 (KR) ..... 10-2004-0112526
Dec. 24, 2004 (KR) ..... 10-2004-0112528

(51) Int. Cl.
*G09G 3/30* (2006.01)
*G09G 3/32* (2006.01)

(52) U.S. Cl. ..... 345/76; 345/77; 345/82; 345/87; 345/98; 345/100

(58) Field of Classification Search ..... 345/55, 345/76, 77, 80, 82, 83, 84, 87, 88, 90, 91, 345/92, 98, 100, 204, 690, 211, 212, 213, 345/214
See application file for complete search history.

(56) References Cited

U.S. PATENT DOCUMENTS 5,172,108 A * 12/1992 Wakabayashi et al. ..... 345/691
6,556,176 B1 * 4/2003 Okuyama et al. ..... 345/76
6,650,060 B2 11/2003 Okuda
6,753,655 B2 6/2004 Shih et al.
6,806,497 B2 * 10/2004 Jo ..... 257/59
6,961,012 B2 * 11/2005 Hsueh ..... 341/135
7,098,877 B2 * 8/2006 Sakamoto et al. ..... 345/82
7,292,219 B2 * 11/2007 Sun ..... 345/100
2006/0139253 A1 * 6/2006 Choi et al. ..... 345/76
2006/0139261 A1 * 6/2006 Choi et al. ..... 345/76

(Continued)

FOREIGN PATENT DOCUMENTS

KR 10-2006-0073690 6/2006

OTHER PUBLICATIONS

Korean Office action in the Korean patent application No. 10-2004-0112528 issued on Jul. 31, 2006.

*Primary Examiner*—My-Chau T Tran
(74) *Attorney, Agent, or Firm*—Robert E. Bushnell, Esq.

(57) ABSTRACT

A light emitting display that includes a pixel portion having a plurality of pixels to display an image, a scan driver to supply a scan signal and an emission control signal to the pixel portion, and a data driver connected to a plurality of data lines each divided into a first data line through which a first current is supplied to the pixel, and a second data line through which a current having the same magnitude as the first current and a data current are induced from the pixel, wherein the data driver includes a current applying circuit to generate the first current, supply the first current to the pixel through the first data line, and receive the first current from the pixel through the second data line; and a data driving integrated circuit to induce the data current in the pixel through the second data line.

15 Claims, 8 Drawing Sheets

U.S. PATENT DOCUMENTS

2006/0139263 A1* 6/2006 Choi et al. ..... 345/76
2006/0139264 A1* 6/2006 Choi et al. ..... 345/76
2006/0145965 A1* 7/2006 Choi et al. ..... 345/76

* cited by examiner

LIGHT EMITTING DISPLAY

CLAIM OF PRIORITY

This application makes reference to, incorporates the same herein, and claims all benefits accruing under 35 U.S.C. § 119 from an application earlier filed in the Korean Intellectual Property Office on 24 Dec. 2004 and there duly assigned Serial Nos. 2004-112525, 2004-112526 and 2004-112528, respectively.

BACKGROUND OF THE INVENTION

1. Field of the Invention

The present invention relates to a light emitting display, and more particularly, to a light emitting display that employs high current to enhance data programming speed, so that the display can have a large size and represent a high gradation.

2. Description of Related Art

Various flat panel displays have recently been developed as alternatives to the relatively heavy and bulky cathode ray tube (CRT) display. The flat panel display includes a liquid crystal display (LCD), a field emission display (FED), a plasma display panel (PDP), a light emitting display, etc.

The light emitting display includes a plurality of light emitting devices, each light emitting device has a structure that an emission layer is placed between a cathode electrode and an anode electrode. Here, an electron and a hole are injected into the emission layer and recombined to create an exciton, and light is emitted when the exciton falls to a lower energy level.

Such a light emitting display is classified into an inorganic light emitting display that includes an inorganic emission layer, and an organic light emitting display that includes an organic emission layer. In current programming type pixel circuit, the current needs to be minutely controlled, so that it takes relatively much time to charge the data signal in the capacitor. For example, in the case where a load provided on the data line has a capacitance of 30 pF, a time of several msec is needed to charge the load with a current of tens of nA to hundreds of nA. However, there is not enough charging time considering a line time of tens of μs. Particularly, when an image is displayed with low brightness, the applied current is also low, thus requiring much more charging time. Therefore, what is needed is an improved design for a light emitting display.

SUMMARY OF THE INVENTION

It is therefore an object of the present invention to provide an improved design for a light emitting display.

It is also an object of the present invention to provide a design for a light emitting display that uses high currents.

It is yet an object of the present invention to provide a design for a light emitting display that results in better data programming speed.

It is further an object of the present invention to provide a design for a light emitting display that allows for a large size display with high gradation.

These and other objects may be achieved by a light emitting display that includes a pixel portion comprising a plurality of pixels adapted to display an image, a scan driver adapted to supply a scan signal and an emission control signal to the pixel portion, and a data driver connected to a plurality of data lines that comprise first data lines through which a first current is supplied to each pixel, and second data lines through which a current having a same magnitude as the first current plus a data current are induced from each pixel, wherein the data driver comprises a current applying circuit adapted to generate the first current for each first data line, supply the first current to the pixels through each first data line, and receive the first current from the pixels through each second data line, the data driver further comprising a data driving integrated circuit adapted to induce the data current from the pixels through each second data line According to an aspect of the invention, wherein the data driver that includes a first transistor comprising a first electrode connected to a first power line, a second electrode connected to a first node, and a gate connected to a second power line, the first transistor being adapted to allow a second current to flow to the first node in correspondence to a signal applied to said first power line, a second transistor comprising a first electrode connected to the first node, a second electrode connected to one of said first data lines, and a gate adapted to selectively supply the first current to said one of said first data lines in correspondence to a first switching signal, a third transistor comprising a first electrode connected to the first node, a second electrode connected to a second node, and a gate adapted to selectively allow the second current to flow to the second node in correspondence to the first switching signal, an fourth transistor comprising a first electrode connected to the second node, a second electrode connected to the one of said second data lines, and a gate selectively supplying a third current from the second data line to the second node in correspondence to the first switching signal, a fifth transistor comprising a first electrode connected to the second node, a second electrode connected to ground, and a gate connected to a third node, a first switch comprising a first terminal connected to the first electrode of the fifth transistor, and a second terminal connected to the gate of the fifth transistor, the first switch being adapted to connect the fifth transistor like a diode to allow the second current to flow through the fifth transistor when closed, and a first capacitor adapted to supply a predetermined voltage to the gate of the fifth transistor enabling the second current to flow through the fifth transistor.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
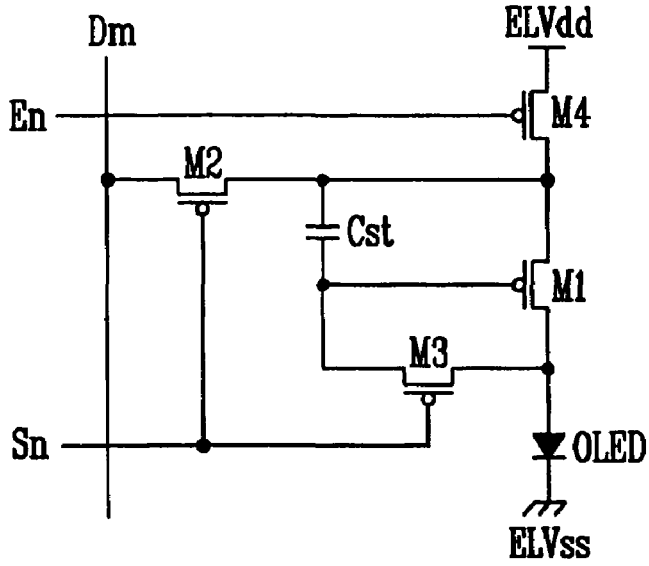
FIG. 1 is a view of a circuit diagram of a current programming type pixel.

Turning now to the figures, FIG. 1 is a view of a circuit diagram of a current programming type pixel. Referring to FIG. 1, a pixel includes an organic light emitting device (OLED) and a pixel circuit. The pixel circuit includes transistors M1 through M4 and a capacitor Cst. Each of the M1 through M4 transistors includes a gate, a source and a drain. Further, the capacitor Cst includes a first electrode and a second electrode.

The amount of current applied to transistor M1 is controlled by current $I_{data}$ applied through the transistor M2. The applied current is maintained for a predetermined period by the capacitor Cst connected between the source and the gate of transistor M1.

The gates of transistors M2 and M3 are connected to a scan line Sn. The source of the transistor M2 is connected to a data line Dm. The source and the drain of transistor M3 are connected to the drain and the gate of transistor M1, respectively. Further, transistor M4 has the source connected to power line ELVdd, the drain connected to the source of transistor M1, and the gate connected to an emission control line En.

With this configuration, the pixel operates as follows. As shown in FIG. 1, when a scan signal sn having a low magnitude is applied to each gate of transistors M2 and M3 transistors M2 and M3 are turned on, thus connecting transistor M1 like a diode and storing a voltage corresponding to the current $I_{data}$ in the capacitor Cst.

When transistors M2 and M3 are turned off by the scan signal sn having a high magnitude and transistor M4 is turned on by an emission control signal en having a low magnitude, power is supplied and a current corresponding to the voltage stored in the capacitor Cst flows from transistor M1 to the organic light emitting device OLED so that the OLED emits light. The current flowing in the OLED is calculated by the following equation 1:

$$I_{data} = \frac{\beta}{2}(Vgs - Vth)^2 = I_{OLED} \quad \text{[Equation 1]}$$

where, $I_{data}$ is a data current, Vgs is a voltage applied between the source and the gate of transistor M1, Vth is a threshold voltage of transistor M1, $I_{OLED}$ is a current flowing in the OLED, and β is a gain factor of transistor M1.

Referring to the equation 1 and the pixel circuit illustrated in FIG. 1, the current ($I_{OLED}$) flowing in the OLED is equal to the data current ($I_{data}$) even though the transistors provided in the pixels have different in the threshold voltages (Vth) and mobilities from each other. Hence, uniform display characteristics are obtained as long as a current programming source of the data driver is uniform throughout the panel of the light emitting display.

In the current programming type pixel circuit, the current needs to be minutely controlled, so that it takes a relatively long time to charge the data signal in the capacitor. For example, in the case where a load provided on the data line has a capacitance of 30 pF, a time of several msec is needed to charge the load using a current of tens of nA to hundreds of nA. However, there is not enough charging time considering a line time of tens of μs. Particularly, when an image is displayed with low brightness, the applied current is also low, thus requiring much more charging time.

Figure 2:
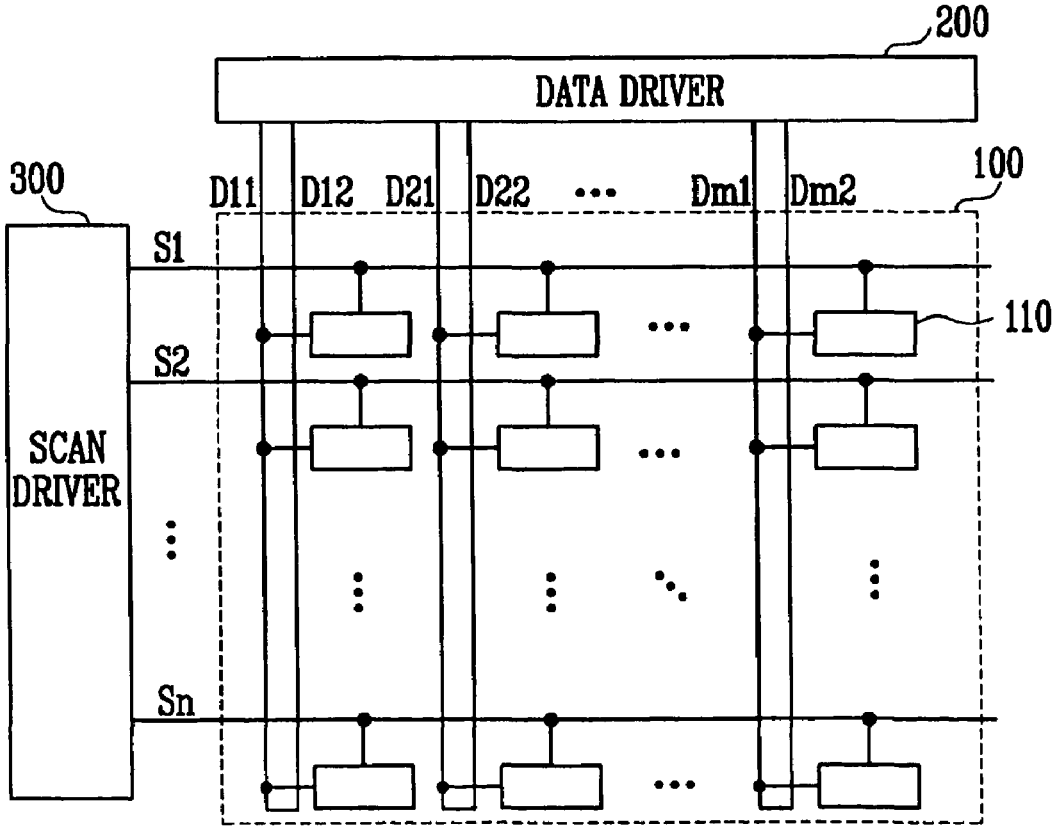
FIG. 2 is a view of a light emitting display according to a first embodiment of the present invention.

Turning now to FIG. 2, FIG. 2 is a view of a layout diagram illustrating a light emitting display according to an embodiment of the present invention. Referring to FIG. 2, a light emitting display according to this embodiment includes a pixel portion 100 that displays an image thereon, a data driver 200 that generates a data signal, and a scan driver 300 that generates a scan signal.

The pixel portion 100 includes a plurality of pixels 110 each including light emitting devices and a pixel circuit, a plurality of scan lines S1, S2, . . . , Sn-1, Sn arranged in a row direction, a plurality of data lines D11, D21, . . . , Dm-11, Dm1 and a plurality of data lines D12, D22, . . . , Dm-12, Dm2, that are arranged in a column direction, and a plurality of power lines ELVdd that supply pixel power to the pixels 110. The plurality of data lines D11, D21, . . . , Dm-11, Dm1 and the plurality of data lines D12, D22, . . . , Dm-12, Dm2 are connected to each other. A signal is output from the plurality of data lines D11, D21, . . . , Dm-11, Dm1, and a signal is input to the plurality of data lines D12, D22, . . . , Dm-12, Dm2. The pixel portion 100 allows currents corresponding to the scan signals supplied from the scan lines S1, S2, . . . , Sn-1, Sn to flow in the OLED, so that the OLED can emit light.

The data driver 200 is connected to the plurality of data lines D11, D21, . . . , Dm-11, Dm1 and the plurality of data lines D12, D22, . . . , Dm-12, Dm2. Here, the data driver 200 supplies current I1 having a high magnitude to the pixels 110 through plurality of data lines D11, D21, . . . , Dm-11, Dm1. Further, the data driver 200 receives currents having the same magnitude as the current I1 plus current $I_{data}$ from the pixels 110 through the plurality of data lines D12, D22, . . . , Dm-12, Dm2, so that the current $I_{data}$ is induced in the pixel 110 by the data driver 200. The induced current $I_{data}$ is then supplied to the OLED, thus allowing the OLED to emit light corresponding to the current $I_{data}$.

Further, parasitic capacitances provided on the plurality of data lines D11, D21, . . . , Dm-11, Dm1 and the plurality of data lines D12, D22, . . . , Dm-12, Dm2 are quickly charged with the current I1 having a high magnitude, thus enhancing a data programming speed. Also, the data driver 200 receives the current I1 plus the current $I_{data}$ from the plurality of data lines D12, D22, . . . , Dm-12, Dm2, thus allowing the pixel 110 to generate the current $I_{data}$.

The scan driver 300 is placed at a lateral side of the pixel portion 110, and is connected to the plurality of scan lines S1, S2, . . . , Sn-1, Sn. Here, the scan driver 300 supplies the scan signal to the pixel 110, and controls the pixel 110 receiving the scan signal to generate the current $I_{data}$. Thus, an emission current that flows in the OLED can be as high as $I_{data}$, thus uniformly representing a desired gradation.

Figure 3:
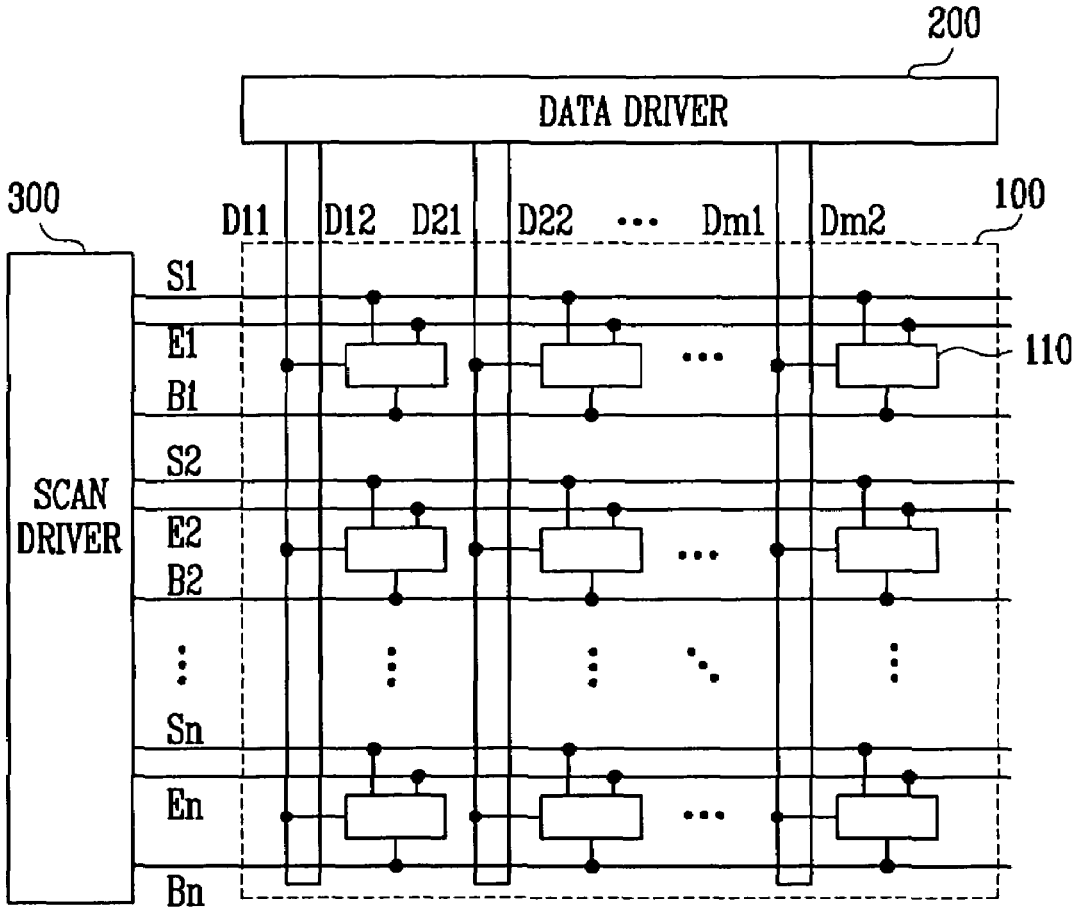
FIG. 3 is another view of a light emitting display according to the first embodiment of the present invention.

Turning to FIG. 3, FIG. 3 is a view of a layout diagram illustrating a first embodiment of a light emitting display according to the present invention. Referring to FIG. 3, a light emitting display according to this embodiment of the present invention includes a pixel portion 100 that displays an image thereon, a data driver 200 that generates a data signal, and a scan driver 300 that generates a scan signal The pixel portion 100 includes a plurality of pixels 110 that each include a light emitting devices and a pixel circuit. A plurality of scan lines S1, S2, . . . , Sn-1, Sn and a plurality of emission control lines E1, E2, . . . , En-1, En, which are arranged in a row direction, a plurality of data lines D1, D2 . . . , Dm-1, Dm arranged in a column direction, a plurality of power lines ELVdd that supply pixel power to the pixels 110, and a plurality of boost lines B1, B2, . . . , Bn-1, Bn that transmit a boosting signal to the pixels 110 are connected to the pixels 110. Each of the data lines D1, D2, . . . , Dm-1, Dm is divided into data lines D11, D21, . . . , Dm-11, Dm1 and data lines D12, D22, . . . , Dm-12, Dm2 that are connected to the data driver 200.

The pixel portion 100 allows currents corresponding to the scan signals supplied through the scan lines S1, S2, . . . , Sn-1, Sn to flow in the OLED, so that the OLED can emit light.

The data driver 200 is connected to the plurality of data lines D11, D21, . . . , Dm-11, Dm1 and the plurality of data lines D12, D22, . . . , Dm-12, Dm2. Here, the data driver 200 supplies current I1 having a high magnitude to the pixels 110 through plurality of data lines D11, D21, . . . , Dm-11, Dm1. Further, the data driver 200 receives currents having the same magnitude as the current I1 plus the current $I_{data}$ from the pixels 110 through the plurality of data lines D12, D22, . . . , Dm-12, Dm2, so that the current $I_{data}$ is induced in the pixel 110 by the data driver 200. The induced current $I_{data}$ is then supplied to the OLED, thus allowing the OLED to emit light corresponding to the current $I_{data}$.

Further, parasitic capacitances provided on the plurality of data lines D11, D21, . . . , Dm-11, Dm1 and the plurality of data lines D12, D22, . . . , Dm-12, Dm2 are quickly charged with the current I1 having a high magnitude, thus enhancing a data programming speed. Also, the data driver 200 receives the current I1 and the current $I_{data}$ from the plurality of data lines D12, D22, . . . , Dm-12, Dm2, thus allowing the pixel 110 to generate the current $I_{data}$.

The scan driver 300 is located at a lateral side of the pixel portion 100, and is connected to the plurality of scan lines S1, S2, . . . , Sn-1, Sn and the plurality of emission control lines E1, E2, . . . , En-1, En. Here, the scan driver 300 supplies the scan signal and the emission control signal to the pixel 110, and controls the pixel 110 receiving the scan signal allowing the pixel 110 to generate the current $I_{data}$. Thus, the scan signal 300 controls the current $I_{data}$ that flows in the OLED enabling the OLED to emit light. Further, the scan driver 300 is connected to the boost lines B1, B2, . . . , Bn-1, Bn, and supplies the boosting signals to the pixels 110.

Figure 4:
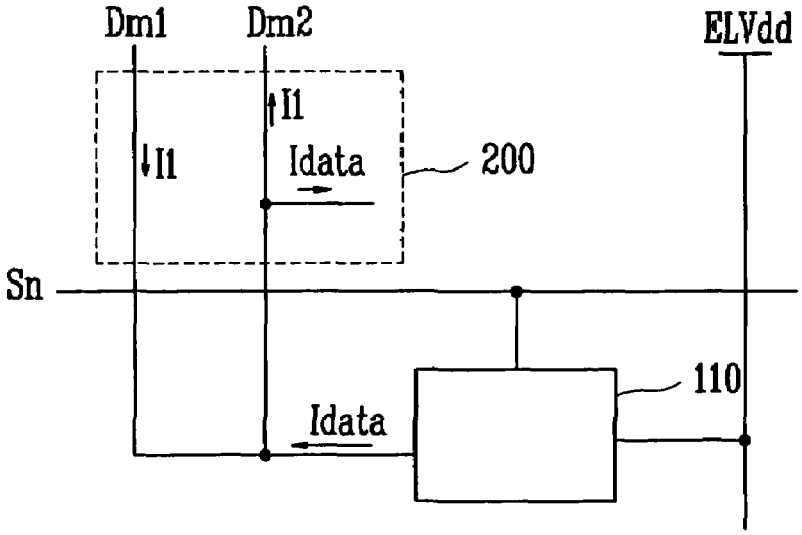
FIG. 4 is a view of current flows in the light emitting display according to an embodiment of the present invention.

Turning now to FIG. 4, FIG. 4 is a view of a diagram illustrating how current flows in the light emitting display according to an embodiment of the present invention. Referring to FIG. 4, when the data driver 200 supplies the current I1 to the pixel through the data line Dm1, there is needed time to charge the current I1 in a load such as the parasitic capacitance or the like provided on the data line. Here, the more the amount of current I1 increases, the amount of time needed to charge the load provided on the data line with the current is reduced.

The data driver 200 receives the current I1 and the current $I_{data}$ from the pixel 110 through the data line Dm2, and the current $I_{data}$ is created in the pixel 110 according to the current conservation law, i.e., Kirchhoff's law because only the current I1 is supplied to the pixel 110. That is, the data driver 200 includes a separate circuit to introduce the current I1 in to the data line Dm1 and at the same time to flow out the current I1 from the data line Dm2, thus driving the pixel 110 to generate the current $I_{data}$. Thus, the pixel 110 stores the voltage for the current $I_{data}$ and make the current having the same magnitude as the current $I_{data}$ flow in the OLED for a predetermined period.

Figure 5:
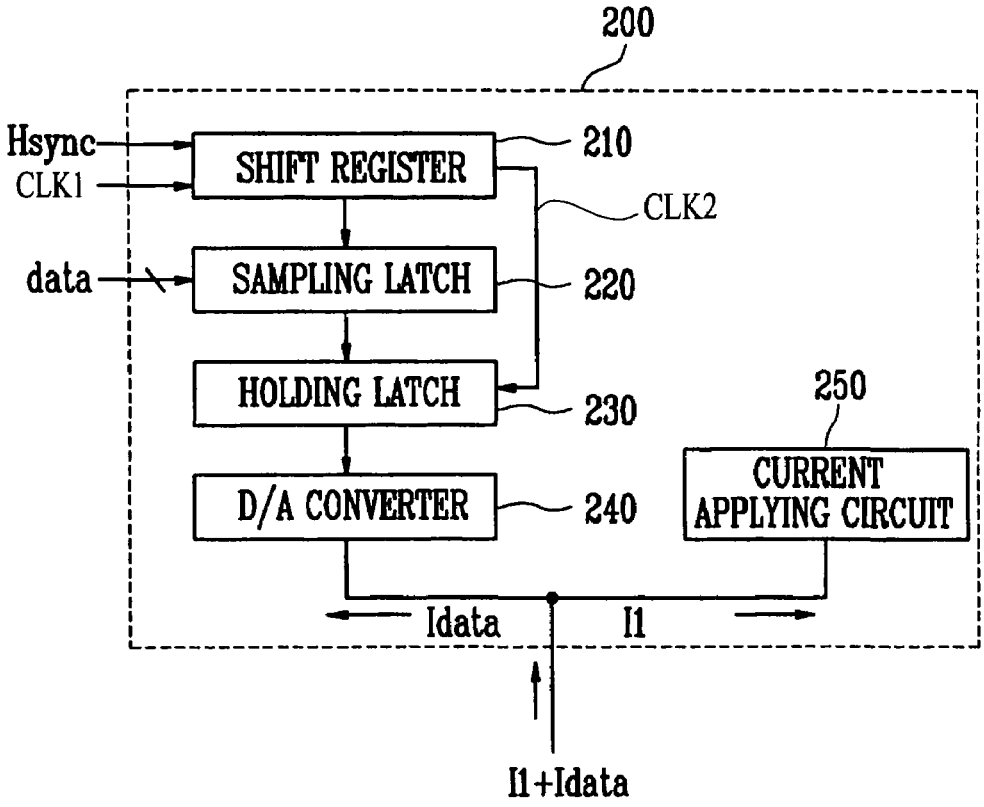
FIG. 5 is a view of a block diagram of a data driver provided in the light emitting display according to an embodiment of the present invention.

Turning now to FIG. 5, FIG. 5 is a view of a block diagram of a data driver 200 provided in the light emitting display according to an embodiment of the present invention. Referring to FIG. 5, the data driver 200 includes a data driving integrated circuit (the entire left hand side of FIG. 5) and a current applying circuit 250. The data driving integrated circuit includes a shift register 210, a sampling latch 220, a holding latch 230, and a digital/analog (D/A) converter 240.

The shift register 210 includes a plurality of flip-flops, and controls the sampling latch 220 on the basis of a clock signal CLK1 and a synchronous signal Hsync. The sampling latch 220 receives the data signals corresponding to one line in sequence and outputs them in parallel on the basis of a control signal of the shift register 210. Further, the shift register 210 transmits an operating signal CLK2 to the holding latch 230 to operate when the sampling latch 220 completely receives the entire data corresponding to one line. The holding latch 230 receives the operating signal CLK2 and outputs signals in parallel. Further, the D/A converter 240 converts a digital data signal into an analog data signal, thus receiving the current $I_{data}$ corresponding the data signal from the pixel 110.

The current applying circuit 250 applies the current I1 to the pixel 110, wherein the current I1 has a high enough magnitude to be easily charged in the load provided on the data line of the pixel 110. Further, the current applying circuit 250 receives a current corresponding to the sum of the current I1 and the current $I_{data}$. Thus, the pixel 110 connected to the data line generates the current corresponding to the current $I_{data}$ in response to the scan signal, and supplies the generated current to the current applying circuit 250 through the data line. At this time, the pixel 110 generates the current $I_{data}$ based on the current I1, and receives the current $I_{data}$ based on the data signal supplied from the D/A converter 240, thus generating the current $I_{data}$ corresponding to the data signal.

Figure 6:
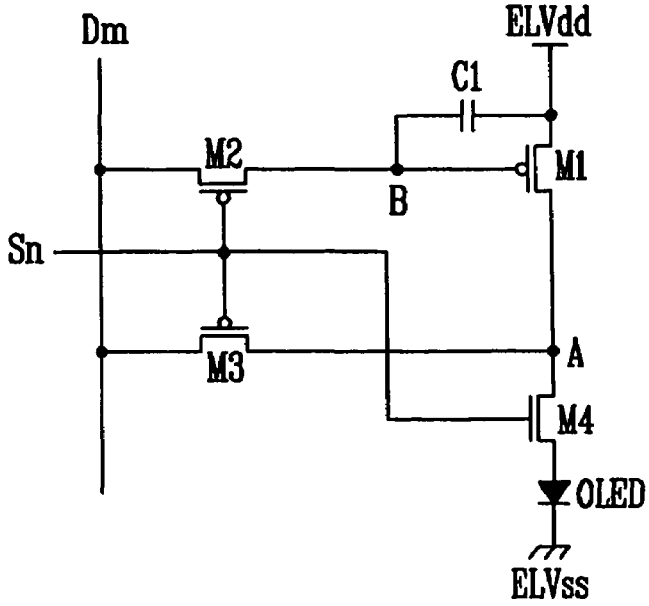
FIG. 6 is a view of a circuit diagram illustrating a pixel of FIG. 2 according to a first embodiment of the present invention.

Turning now to FIG. 6, FIG. 6 is a view of a circuit diagram illustrating a first embodiment of a pixel 110 employed in the light emitting display shown in FIG. 2. Referring to FIG. 6, the pixel 110 includes the pixel circuit and the OLED. The pixel circuit includes transistors M1 through M4 and capacitor C1. Each of transistors M1 through M4 includes a source, a drain and a gate. Further, capacitor C1 includes a first electrode and a second electrode. Here, transistors M1 through M4 are metal oxide semiconductor (MOS) transistors. Meanwhile, there is no physical difference between the source and the drain of each transistor, so that they can be instead referred to as a first electrode and a second electrode.

In FIG. 6, the transistors M1 through M3 are p-channel MOS (PMOS) transistors, and transistor M4 is an n-channel MOS (NMOS) transistor. Further, the OLED is connected to transistor M4, and receives a current through transistor M4, thus emitting light.

Regarding transistor M1, the source is connected to the power line ELVdd to receive the pixel power, the drain is connected to node A, and the gate is connected to node B. In transistor M1, a constant current flows from the source to the drain based on the voltage applied between the gate and the source.

Regarding transistor M2 the source is connected to the data line, the drain is connected to node B and the gate is connected to the scan line Sn. Here, transistor M2 supplies the current flowing in the data line Dm to the gate of transistor M1 in response to the scan signal input through the scan line Sn.

Regarding transistor M3 the source is connected to the data line Dm, the drain is connected to node A, and the gate is connected to the scan line Sn. Here, transistor M3 supplies the current flowing in the data line Dm to node A in response to the scan signal input through the scan line Sn.

Regarding transistor M4, the source is connected to node A, the drain is connected to the OLED, and the gate is connected to the scan line Sn. Here, transistor M4 supplies the current introduced through node A to the OLED in response to the scan signal input through the scan line Sn. Further, because transistors M2 and M3 are PMOS transistors and transistor M4 is an NMOS transistor, transistor M4 is turned on when transistors M2 and M3 are turned off, and M4 is turned off when transistors M2 and M3 are turned on.

Regarding capacitor C1, the first electrode is connected to the power line ELVdd, and the s second electrode is connected to node B. Here, capacitor C1 stores the voltage for the current $I_{data}$ flowing from the power line ELVdd toward the pixel 110, and maintains the voltage for a predetermined period, thus allowing the current $I_{data}$ to flow in the OLED.

With this configuration, the pixel 110 operates as follows. When the scan signal having a low magnitude is input when the current I1 is being supplied from the data driver 200 to the data line Dm, transistors M2 and M3 are turned on and transistor M4 is turned off. Then, voltages having the same magnitude are applied to the gate and the drain of transistor M1 by transistors M2 and M3, so that transistor M1 is connected (or behaves) like a diode. Further, transistor M3 is turned on by the scan signal, so that a current path is formed between the power line ELVdd and the data line Dm. Thus, the data driver 200 allows the current $I_{data}$ to flow from the pixel 110 to the data line Dm. At this time, the voltage for the current $I_{data}$ is applied to the gate of transistor M1, so that capacitor C1 is charged with a predetermined voltage corresponding to the current $I_{data}$ flowing in the pixel 110.

Further, when the scan signal having a high magnitude is input, transistors M2 and M3 are turned off and transistor M4 is turned on. At this time, the voltage applied between the gate and the source of transistor M1 is maintained by the voltage charged in capacitor C1, causing the current $I_{data}$ to flow through transistor M1 to flow to transistor M4. Further, as transistor M4 is turned on, the current $I_{data}$ flows through the OLED, thus making the OLED emit light.

Figure 7:
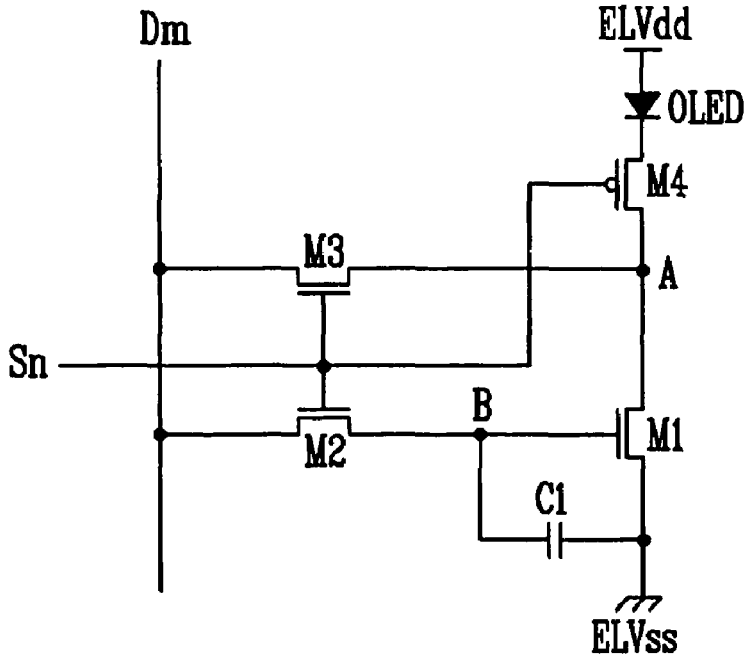
FIG. 7 is a view of a circuit diagram of the pixel shown in FIG. 6, which employs an NMOS transistor as a first transistor.

In an alternative embodiment, transistors M1 through M3 can be NMOS transistors and transistor M4 can be a PMOS transistor as illustrated in FIG. 7.

Figure 8:
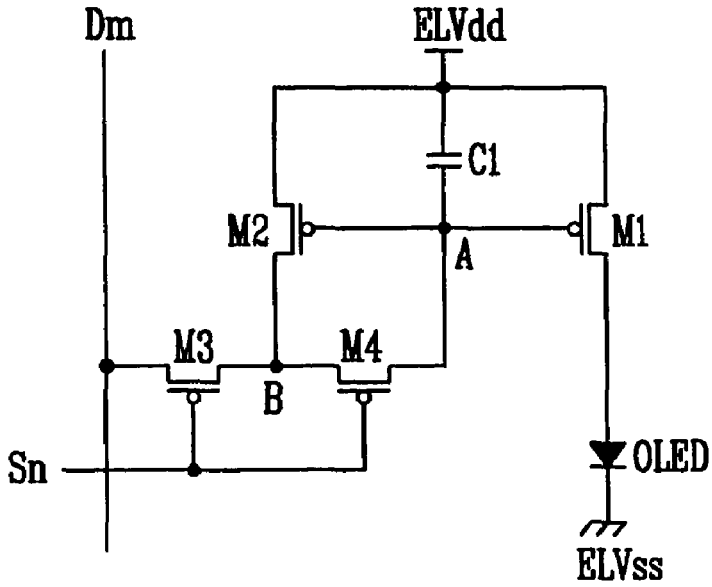
FIG. 8 is a view of a circuit diagram illustrating a second embodiment of the pixel employed in the light emitting display shown in FIG. 2.

FIG. 8 is view of a circuit diagram illustrating a second embodiment of the pixel 110 employed in the light emitting display of FIG. 2. Referring to FIG. 8, the pixel 110 includes the pixel circuit and the OLED. The pixel circuit includes transistors M1 through M4 and capacitor C1. Each of transistors M1 through M4 includes a source, a drain and a gate. Further, capacitor C1 includes a first electrode and a second electrode. In FIG. 8, transistors M1 through M4 are illustrated as being PMOS transistors. There is no physical difference between the source and the drain of each transistor, so that they can instead be called a first electrode and a second electrode. Further, the OLED is connected to transistor M4, and receives a current through transistor M4, thus generating light.

Regarding transistor M1, the source is connected to the power line ELVdd to receive the pixel power, the drain is connected to the OLED, and the gate is connected to node A. In transistor M1, a constant current flows from the source to the drain based on the voltage applied between the gate and the source.

Regarding transistor M2 the source is connected to the power line ELVdd, the drain is connected to node B and the gate is connected to node A. Here, transistor M1 and transistor M2 have different gatge sizes from each other. Therefore, when the same voltage is applied to the gates of transistors M1 and M2 the current flowing from the source to the drain of transistor M2 is higher than the current flowing from the source to the drain of transistor M1. For example, when a current of 1 mA flows in transistor M2 a current of 0.01 mA flows in transistor M1.

Regarding transistor M3 the source is connected to the data line Dm, the drain is connected to node B, and the gate is connected to the scan line Sn. Here, transistor M3 supplies the current flowing in the data line Dm to node B in response to the scan signal input through the scan line Sn.

Regarding transistor M4, the source is connected to node B, the drain is connected to node A, and the gate is connected to the scan line Sn. Here, transistor M4 allows the same voltage to be applied to node A and node B in response to the scan signal input through the scan line Sn, thus connecting transistor M2 like a diode.

Regarding capacitor C1, the first electrode is connected to the power line ELVdd, and the second electrode is connected to node A. Here, capacitor C1 stores the voltage applied to node A, and maintains the voltage for a predetermined period, thus allowing a current corresponding to the current $I_{data}$ to flow in the OLED.

With this configuration, the pixel 110 operates as follows. When the scan signal having a low magnitude is input while the current I1 is being supplied from the data driver 200 to the data line Dm, transistors M3 and M4 are turned on.

Then, voltages having the same magnitude are applied to the gate and the drain of transistor M2 by transistors M3 and M4, so that transistor M2 is connected like a diode. Further, transistor M3 is turned on by the scan signal, so that a current path is formed between the power line ELVdd and the data line Dm. Thus, the data driver 200 allows the current $I_{data}$ to flow from the pixel 110 to the data line Dm. At this time, the voltage for the current $I_{data}$ is applied to the gate of transistor M2 so that capacitor C1 is charged with a predetermined voltage corresponding to the current $I_{data}$ flowing in the pixel 110.

Further, when the scan signal having a high magnitude is input, transistors M3 and M4 are turned off and thus the data line and node A enter a floating state. Therefore, the voltage stored in capacitor C1 is maintained. Further, the voltage stored in capacitor C1 is supplied to the gate of transistor M1, so that a current flows through transistor M1. At this time, the gate of transistor M1 and the gate of transistor M2 are different in size, so that the amount of current smaller than that flowing through transistor M2 flows through transistor M1. That is, a current less than that flowing in transistor M2 is supplied to the OLED.

Thus, in the pixel 110, the current $I_{data}$ is induced by the current I1 supplied through the data line, and the current corresponding to the current $I_{data}$ is supplied to the light emitting device, thus allowing the light emitting device to emit light. That is, the current $I_{data}$ having a high magnitude is induced by the current I1 input to the data line. Further, the pixel has a mirror structure, and thus the current smaller than the current $I_{data}$ flows in the OLED. Therefore, the data line is charged with the current I1 which is much higher than the current flowing in the OLED, so that time taken to charge the data line is shortened.

Figure 9:
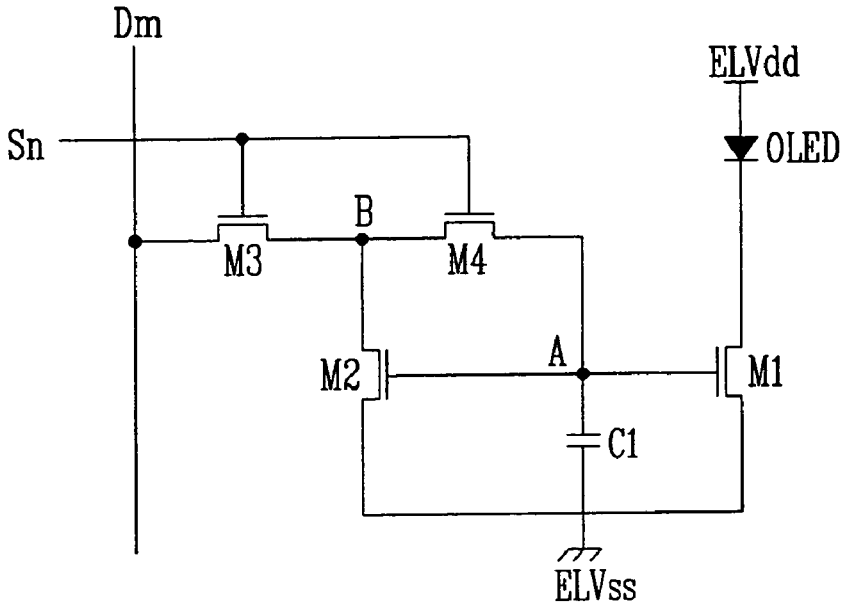
FIG. 9 is a view of a circuit diagram of the pixel shown in FIG. 8, which employs an NMOS transistor as a first transistor.

Alternatively, transistors M1 through M4 can instead be NMOS transistors as illustrated in FIG. 9.

Figure 10:
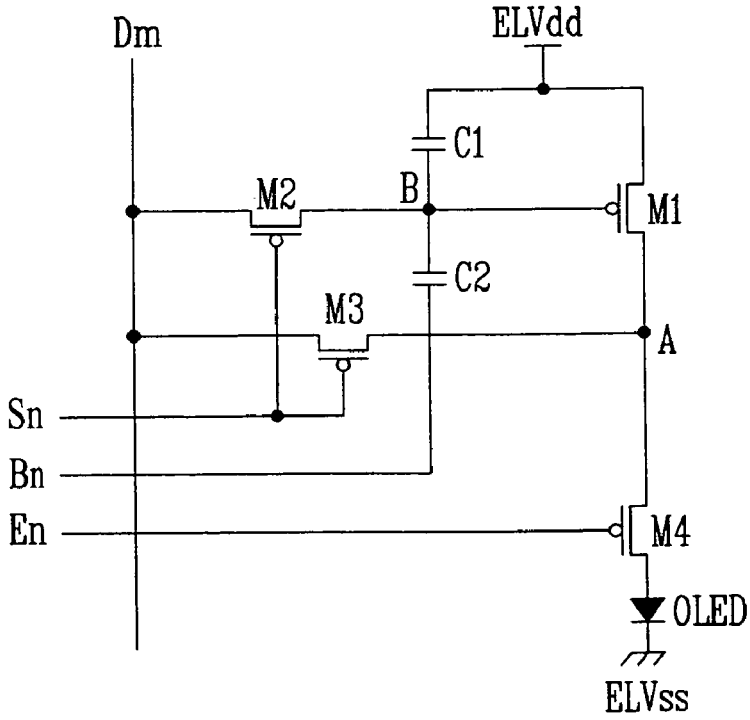
FIG. 10 is a view of a circuit diagram illustrating a first embodiment of a pixel employed in the light emitting display shown in FIG. 3.

FIG. 10 is a view of a circuit diagram illustrating a pixel employed in the light emitting display shown in FIG. 3 according to a first embodiment of the present invention. Referring to FIG. 10, the pixel 110 includes a OLED and a pixel circuit. Each pixel circuit is connected with two light emitting devices OLED. Further, each pixel circuit includes transistors M1 through M4 and capacitors C1 and C2.

Transistors M1 through M4 are illustrated in FIG. 10 as being PMOS transistors. In the embodiment of FIG. 10, there is no physical difference between a source and a drain of each transistor, so that they can instead be called a first electrode and a second electrode. Also, each of capacitors C1 and C2 includes a first electrode and a second electrode.

Regarding transistor M1, the source is connected to the power line ELVdd to receive the pixel power, the drain is connected to node A, and the gate is connected to node B. Here, transistor M1 supplies the current to node A in correspondence to the voltage applied to node B.

Regarding transistor M2 the source is connected to the data line Dm, the drain is connected to node B, and the gate is connected to the scan line Sn. Here, transistor M2 supplies the data signal to node B in response to the scan signal supplied through the scan line Sn.

Regarding transistor M3 the source is connected to node A, the drain is connected to the data line Dm and the gate is connected to the scan line Sn. Here, the current flowing from the source to the drain of transistor M1 flows from the source to the drain of transistor M3 in response to the scan signal supplied through the scan line Sn.

Regarding capacitor C1, the first electrode is connected to the power line ELVdd, and the second electrode is connected to node B, thus maintaining the voltage corresponding to the data signal for a predetermined period.

Regarding capacitor C2, the first electrode is connected to node B, and the second electrode is connected to the boost signal line Bn, thus lowering the voltage applied to the gate of transistor M1 in correspondence to the boosting signal. Then, the current flowing from the source to the drain of transistor M1 becomes smaller. Thus, the current flowing in the OLED is smaller than the current $I_{data}$, so that the current I1 for charging the data line becomes much larger, thus further reducing the time taken to charge the data line.

Regarding transistor M4, the source is connected to node A, the drain is connected to the OLED, and the gate is connected to the emission control line En. Here, transistor M4 supplies the current generated by transistor M1 to the OLED via node A in correspondence to the emission control signal en supplied through the emission control line En.

Figure 11:
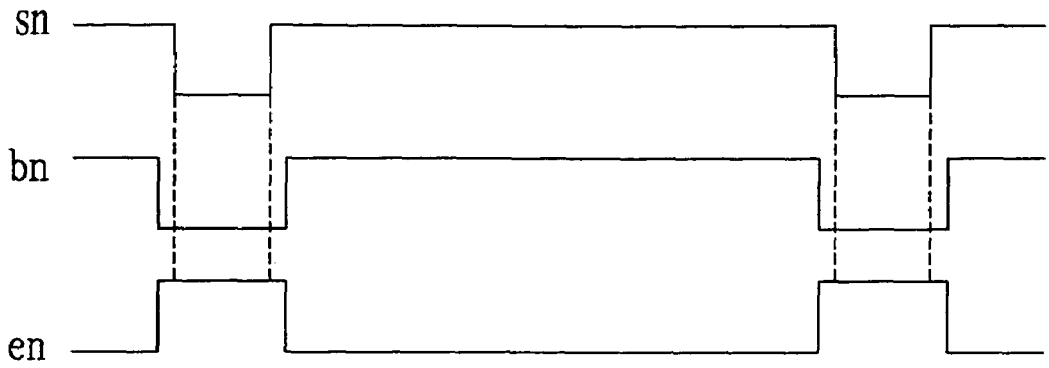
FIG. 11 is a view of waveforms of signals to be supplied to the light emitting display comprising the pixel shown in FIG. 10.

Turning now to FIG. 11, FIG. 11 is a view of waveforms of signals to be supplied to the light emitting display having a pixel design of FIG. 10. Referring to FIG. 11, the pixel is operated by a scan signal sn, a current $I_{data}$, a boosting signal bn, and an emission control signal en.

While the emission control signal en is a positive signal, the boosting signal bn is a negative signal. The scan signal sn is a negative signal within a period while the boosting signal bn is of a negative signal.

When the scan signal is a negative signal, transistors M2 and M3 are turned on, so that the current $I_{data}$ flows from the source to the drain of transistor M1. At this time, transistor M1 is connected like a diode in correspondence to the current $I_{data}$. Here, the voltage applied to the gate and the source of transistor M1 can be calculated by the following equation 2.

$$I_{data} = \frac{\beta}{2}(Vgs - Vth)^2 \qquad \text{[Equation 2]}$$

$$Vgs = \sqrt{\frac{2I_{data}}{\beta}} + Vth$$

where, $I_{data}$ is a data current, Vgs is a voltage applied between the source and the gate of transistor M1, Vth is a threshold voltage of transistor M1, and β is a gain factor of transistor M1.

On the other hand, when the scan signal sn is a positive signal, the transistors M2 and M3 are turned off, the emission control signal en is a negative signal, thus turning on transistor M4. When transistor M4 is turned on, the current flowing in transistor M1 is supplied to the OLED through transistor M4, thus allowing the OLED to emit light.

In FIG. 11, when transistor M2 is turned off, the voltage applied to the gate of transistor M1 is increased due to coupling between capacitor C1 and capacitor C2. Here, the increased voltage can be calculated by the following equation 3.

$$\Delta Vg = \frac{\Delta V_{bn} \cdot C2}{C1 + C2} \qquad \text{[Equation 3]}$$

where, ΔVg is the increase in voltage applied to the gate of transistor M1 due to the coupling between capacitors C1 and C2, and $\Delta V_{bn}$ is a voltage width of a boosting signal.

Further, the current flowing in the OLED can be calculated by the following equation 4.

$$I_{OLED} = \frac{\beta}{2}(Vgs - \Delta Vg - Vth)^2 \qquad \text{[Equation 4]}$$

where, $I_{OLED}$ is a current flowing in the OLED, Vgs is a voltage applied between the source and the gate of transistor M1 when the current $I_{data}$ flows in transistor M1, ΔVg is the increase in voltage applied to the gate of transistor M1 due to the coupling between capacitors C1 and C2, Vth is a threshold voltage of transistor M1, and β is a gain factor of transistor M1.

Figure 12:
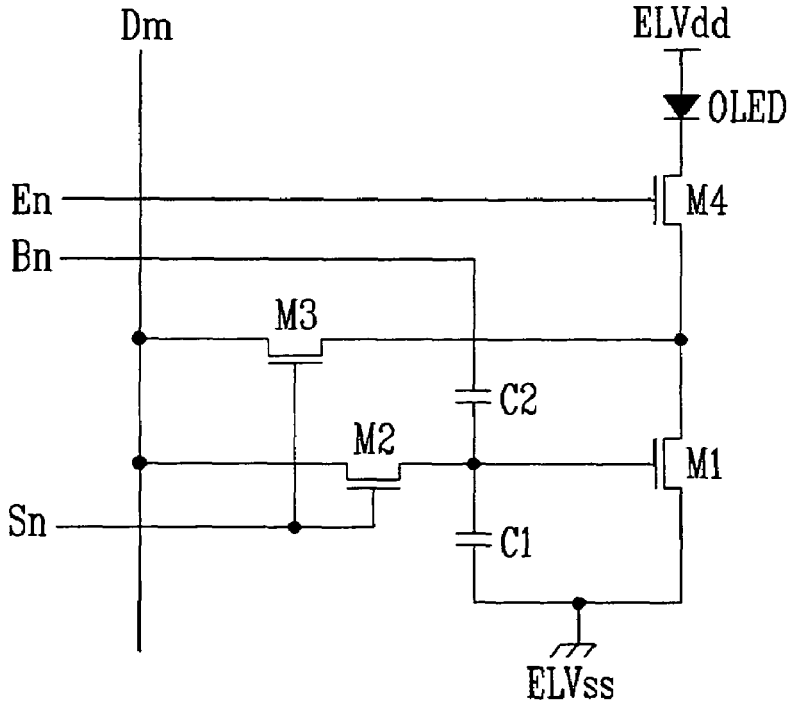
FIG. 12 is a view of a circuit diagram of the pixel shown in FIG. 10, which employs an NMOS transistor as a first transistor.
Figure 13:
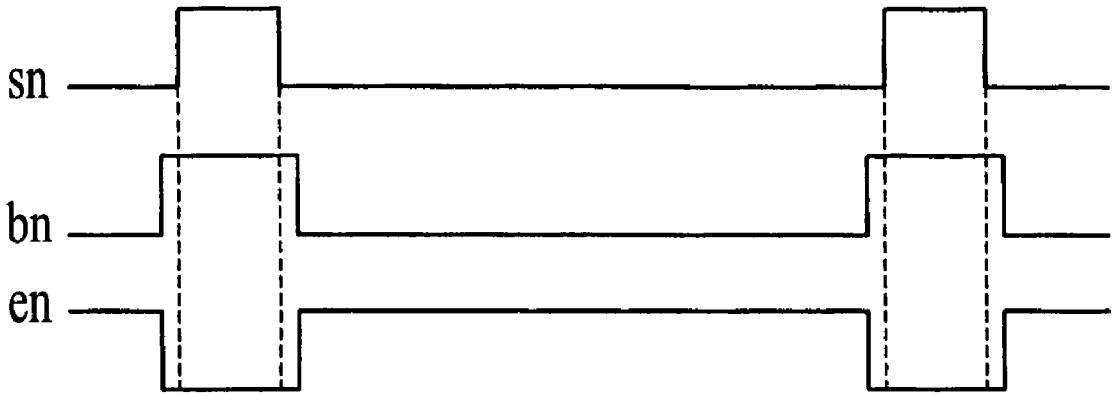
FIG. 13 is a view of waveforms of signals to be supplied to the light emitting display comprising the pixel shown in FIG. 12.

Alternatively, transistors M1 through M4 can instead be NMOS transistors as illustrated in FIG. 12. For the arrangement of FIG. 12, the pixel of FIG. 12 can be operated by signals illustrated in FIG. 13.

Figure 14:
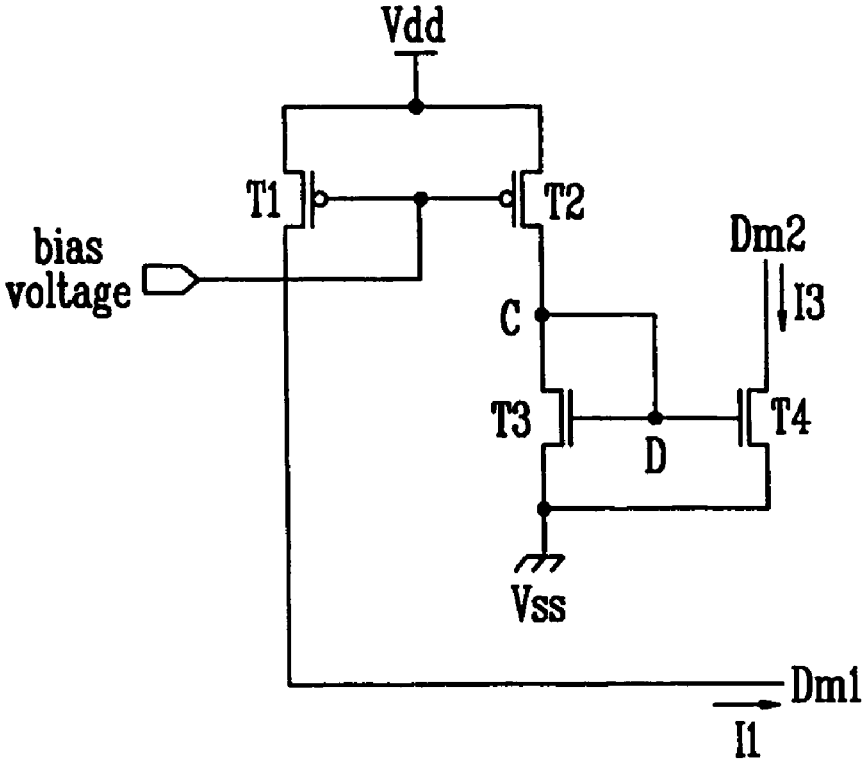
FIG. 14 is a view of a circuit diagram of a current applying circuit employed in a data driver of the light emitting display according to a first embodiment of the present invention.

Turning now to FIG. 14, FIG. 14 is a view of a circuit diagram illustrating a first embodiment of a current applying circuit 250 employed in a data driver 200 of the light emitting display according to an embodiment of the present invention. Referring to FIG. 14, the current applying circuit 250 includes transistors T1 through T4, each having a source, a drain and a gate. In FIG. 14, transistors T1 and T2 are illustrated as being PMOS transistors, and transistors T3 and T4 are illustrated as being NMOS transistors.

Transistor T1 and transistor T2 are connected as a mirror structure. That is, the gates of transistors T1 and T2 are connected to each other. The gates of transistors T1 and T2 are connected to a power line called "bias voltage". Regarding transistor T1, the source is connected to power line Vdd, and the drain is connected to the data line Dm1. Regarding transistor T2, the source is connected to the power line Vdd, and the drain is connected to node C.

The gate for each of transistors T3 and T4 is connected to node D. Regarding transistor T3, the source is connected to node C and the drain is connected to a ground (aka Vss). In FIG. 14, the source and the gate of transistor T3 are connected and make transistor T3 have a diode-like connection. In other words, the gate and the source of transistor T3 are shorted together so that transistor T3 behaves like a diode. Regarding transistor T4, the source is connected to a data line Dm2 and the drain is connected to the ground Vss. In FIG. 14, transistor T3 and transistor T4 are connected as a mirror structure.

The current applying circuit 250 of FIG. 14 operates as follows. Transistors T1 and T2 are turned on by the power line labeled "bias voltage", and transistor T1 allows a current I1 to flow in the data line Dm1 based on the bias voltage applied to the gate of T1. The bias voltage has a high enough magnitude to allow transistor T1 to have current I1 flow between the source and the drain of T1.

When transistor T1 has current I1 flowing between the source and the drain, transistor T2 allows a current having the same magnitude as the current I1 to flow between the source and drain of T2 because transistor T2 is connected to transistor T1 in the mirror structure. When this is occurring, transistor T3 is connected like a diode, so that the current flowing in transistor T2 flows to the ground Vss via transistor T3. Further, transistor T4 connected as the mirror structure with transistor T3 induces the same current as that flowing in transistor T3, and receives current I3 having the same magnitude as the current from the data line Dm2. Thus, the current applying circuit 250 of FIG. 14 applies the current I1 to flow in the data line Dm1, and receives current I3 having the same magnitude as the current I1 from the data line Dm2.

Figure 15:
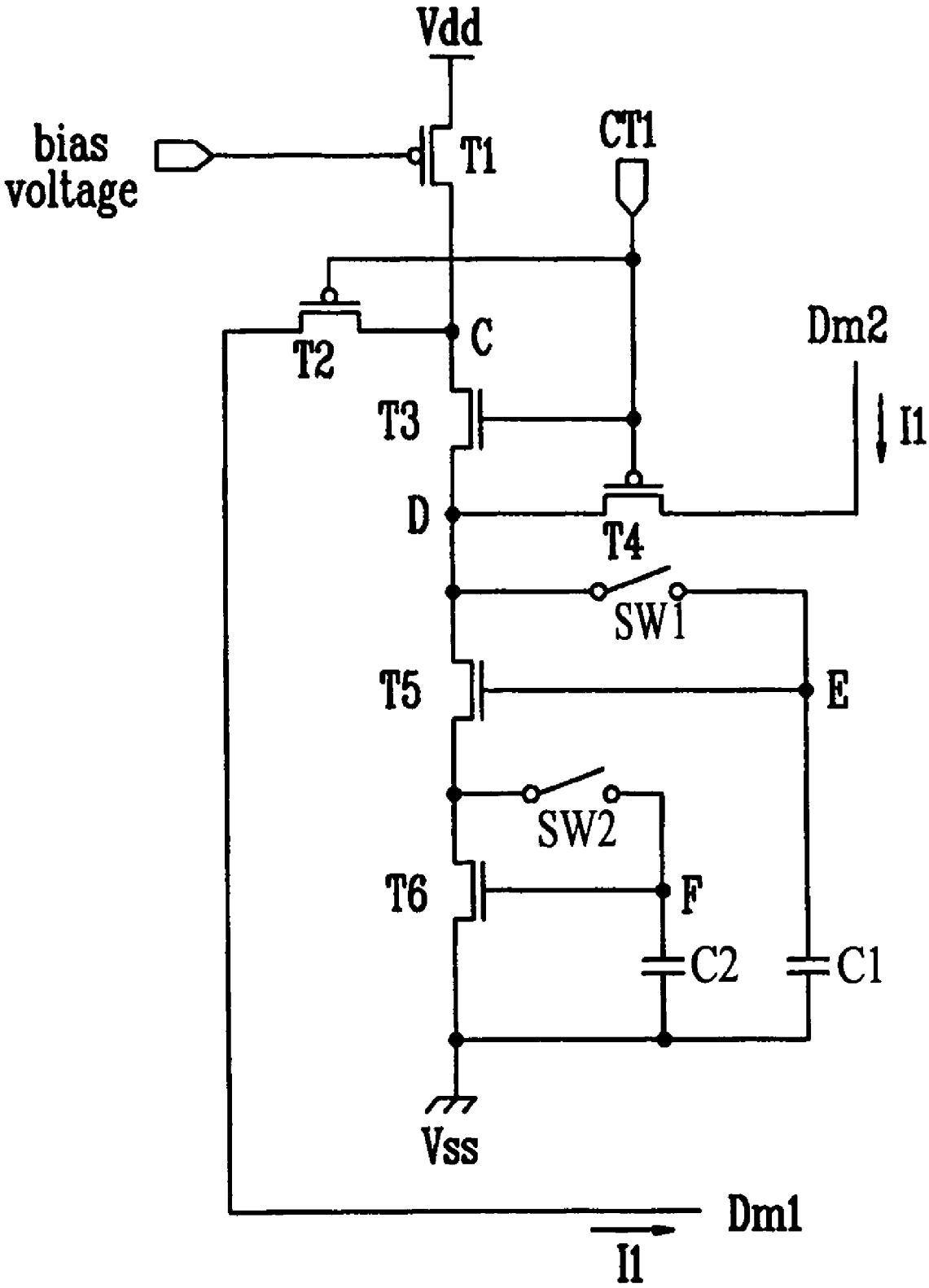
FIG. 15 is a view of a circuit diagram of a current applying circuit employed in a data driver of the light emitting display according to a second embodiment of the present invention.

Turning now to FIG. 15, FIG. 15 is a view of a circuit diagram of a current applying circuit employed in a data driver of the light emitting display according to a second embodiment of the present invention. Referring to FIG. 15, the current applying circuit 250 includes transistors T1 through T6 each having a source, a drain and a gate. Current applying circuit 250 of FIG. 15 also includes capacitors C2 and C3, and switches SW1 and SW2. Here, transistors T1, T2 and T4 are illustrated as being PMOS transistors, and transistors T3, T5 and T6 are illustrated as being NMOS transistors. Further, switches SW1 and SW2 perform a switching operation according to input signals.

Regarding transistor T1, the source is connected to power Vdd, the drain is connected to node C, and the gate is connected to the power line labeled "bias voltage". The power line labeled "bias voltage" supplies a bias voltage, and transistor T1 allows current I1 to flow to node C based on the bias voltage.

Regarding transistor T2, the source is connected to node C, the drain is connected to the data line Dm1, and the gate is connected to switching control line CT1. Here, transistor T2 performs a switching operation depending on a first switching signal input through switching control line CT1.

Regarding transistor T3, the source is connected to node C, the drain is connected to node D, and the gate is connected to switching control line CT1. Here, transistor T3 performs a switching operation depending on the first switching signal input through switching control line CT1.

Regarding transistor T4, the source is connected to the data line Dm2, the drain is connected to node D, and the gate is connected to switching control line CT1. Here, transistor T4 performs a switching operation depending on the first switching signal input through switching control line CT1.

Regarding transistor T5, the source is connected to node D, the drain is connected to the source of transistor T6, and the gate is connected to node E, thus flowing a current therein between source and drain based on a voltage applied to node E.

Regarding transistor T6, the source is connected to the drain of transistor T5, the drain is connected to ground Vss, and the gate is connected to node F, thus allowing a current to flow between source and drain based on a voltage applied to node F.

Regarding capacitor C2 the first electrode is connected to node E, and the second electrode is connected to ground Vss. Capacitor C2 stores a predetermined voltage and supplies this voltage to the gate of transistor T5.

Regarding capacitor C3, the first electrode is connected to node F, and the second electrode is connected to ground Vss. Capacitor C3 stores a predetermined voltage and supplies this voltage to the gate of transistor T6.

Regarding switch SW1, the first terminal is connected to node D, and the second terminal is connected to node E. Thus, the voltage applied to node D is equalized with the voltage applied to node E according to the switching operation of switch SW1, thus allowing transistor T5 to have a diode-like connection. Thus, a current flows from the source to the drain of transistor T5.

Regarding switch SW2, a first terminal connected to the source of transistor T6, and a second terminal connected to node F. Thus, transistor T6 has a diode-like connection based on the switching operations of switch SW2.

According to an embodiment of the present invention, switches SW1 and SW2 receive the same control signal, i.e., the second switching signal, and are turned on and off at the same time.

The current applying circuit 250 operates as follows. In the state that the current applying circuit 250 receives the power Vdd and power from power line labeled "bias voltage", when switching control line CT1 having a high magnitude is input, transistors T2 and T4 are turned off and transistor T3 is turned on. Then, switches SW1 and SW2 are turned on by the second switching signal, so that transistors T5 and T6 are respectively connected like a diode, thus forming a current path between node C and ground Vss. Thus, transistor T1 allows the current I1 flow to node C, thus making the current I1 to flow toward ground Vss.

At this time, when the current I1 flows in transistor T5 and transistor T6, a predetermined voltage for the current I1 is applied to each gate of transistors T5 and T6. Thus, transistors T5 and T6 allow the voltage for the current I1 to be charged in capacitors C2 and C3.

When switches SW1 and SW2 are turned off by the second switching signal, transistors T2 and T3 are simultaneously turned on and transistor T4 is simultaneously turned off by the first switching signal, the current I1 flowing to node C from transistor T1 is applied to the data line Dm1 through transistor T2. Further, transistor T3 is turned on, thus forming a current path between the data line Dm and node D. Now, the voltage for the current I1 stored in capacitors C2 and C3 is applied to gates of each of transistors T5 and T6. Therefore, the current having the same magnitude as the current I1 is induced in transistors T5 and T6, and thus the current having the same magnitude as the current I1 flows to ground Vss through the data line Dm2 via transistors T4, T5 and T6.

As described above, the present invention provides a light emitting display using a current driving type pixel structure, in which the structure of a driver is simplified, a high gradation is represented, and a life span is lengthened. Further, a large current flows in a data line, so that a parasitic capacitor provided in the data line can be quickly charged with the high current, thus enhancing a data programming speed.

Although a few embodiments of the present invention have been shown and described, it would be appreciated by those skilled in the art that changes might be made in this embodiment without departing from the principles and spirit of the invention, the scope of which is defined in the claims and their equivalents.

What is claimed is:

1. A light emitting display, comprising:

a pixel portion comprising a plurality of pixels adapted to display an image;

a scan driver adapted to supply a scan signal and an emission control signal to the pixel portion; and a data driver connected to a plurality of data lines that comprise first data lines through which a first current is supplied to each pixel, and second data lines through which a current having a same magnitude as the first current plus a data current are induced from each pixel, wherein the data driver comprises a current applying circuit adapted to generate the first current for each first data line, supply the first current to the pixels through each first data line, and receive the first current from the pixels through each second data line, the data driver further comprises a data driving integrated circuit adapted to induce the data current from the pixels through each second data line.

2. The light emitting display of claim 1, wherein each pixel comprises:

a light emitting device;

a first transistor adapted to allow a data current to pass therethrough in correspondence to a voltage applied to a gate thereof;

a second transistor adapted to selectively connect the first transistor like a diode in response to the scan signal;

a third transistor adapted to supply the data current to the first transistor in response to the scan signal;

a fourth transistor adapted to allow the data current to flow in the light emitting device in correspondence to the emission control signal;

a first capacitor adapted to store a voltage having a first magnitude in correspondence to the data current supplied to the first transistor; and a second capacitor connected with the first capacitor in series and adapted to change the voltage having the first magnitude stored in the first capacitor to have a second magnitude.

3. The light emitting display of claim 2, wherein the second magnitude is obtained by adding a voltage magnitude corresponding to a boosting signal to the first magnitude.

4. The light emitting display of claim 3, wherein the boosting signal varies a voltage to be charged in the second capacitor when the second and third transistors are turned on.

5. The light emitting display of claim 1, wherein each pixel comprises:

a light emitting device;

a first transistor comprising a first electrode connected to a first power line, a second electrode connected to a first node, and a gate connected to a second node;

a second transistor comprising a first electrode connected to one of said data lines, a second electrode connected to the second node, and a gate connected to a scan line;

a third transistor comprising a first electrode connected to said one of said data lines, a second electrode connected to the first node, and a gate connected to the scan line;

a fourth transistor comprising a first electrode connected to the first node, a second electrode connected to the light emitting device, and a gate connected to the scan line, the fourth transistor being in inverse relation to the second and third transistors; and a first capacitor comprising a first electrode connected to the first power line, and a second electrode connected to the second node.

6. The light emitting display of claim 5, wherein the first transistor is connected like a diode when the second and third transistors are turned on.

7. The light emitting display of claim 1, wherein each pixel comprises:

a light emitting device;

a first transistor comprising a first electrode connected to a first power line, a second electrode connected to the light emitting device, and a gate connected to a first node;

a second transistor comprising a first electrode connected to the first power line, a second electrode connected to a second node, and a gate connected to the first node;

a third transistor comprising a first electrode connected to one of said data lines, a second electrode connected to the second node, and a gate connected to a scan line;

a fourth transistor comprising a first electrode connected to the second node, a second electrode connected to the first node, and a gate connected to the scan line; and a first capacitor comprising a first electrode connected to the first power line, and a second electrode connected to the first node.

8. The light emitting display of claim 7, wherein the first transistor is connected like a diode when the second and third transistors are turned on.

9. The light emitting display of claim 7, wherein the gates of the first transistor and the second transistor are adapted to make an amount of current flowing in the second transistor greater than an amount of current flowing in the first transistor.

10. The light emitting display of claim 1, wherein the current applying circuit comprises:

a first transistor comprising a first electrode connected to a first power line, a second electrode connected to one of said first data lines, and a gate connected to a second power line, the first transistor being adapted to allow the first current to flow in said one of said first data lines in correspondence to a signal applied to the second power line;

a second transistor comprising a first electrode connected to the first power line, a second electrode connected to a first node, and a gate connected to the second power line, the second transistor being adapted to allow a second current having a same magnitude as the first current to flow to the first node;

a third transistor comprising a first electrode connected to the first node, a second electrode connected to ground, and a gate connected to a second node, the third transistor being adapted to be connected like a diode by the second current to make the second current to flow toward ground; and an fourth transistor comprising a first electrode connected to said one of said second data lines, a second electrode connected to ground, and a gate connected to the second node, the fourth transistor being adapted to receive a third current having the same magnitude as the second current from the one of said second data lines.

11. The light emitting display of claim 1, wherein the current applying circuit comprises:

a first transistor comprising a first electrode connected to a first power line, a second electrode connected to a first node, and a gate connected to a second power line, the first transistor being adapted to allow a second current to flow to the first node in correspondence to a signal applied to said first power line;

a second transistor comprising a first electrode connected to the first node, a second electrode connected to one of said first data lines, and a gate adapted to selectively supply the first current to said one of said first data lines in correspondence to a first switching signal;

a third transistor comprising a first electrode connected to the first node, a second electrode connected to a second node, and a gate adapted to selectively allow the second current to flow to the second node in correspondence to the first switching signal;

an fourth transistor comprising a first electrode connected to the second node, a second electrode connected to the one of said second data lines, and a gate selectively supplying a third current from the second data line to the second node in correspondence to the first switching signal;

a fifth transistor comprising a first electrode connected to the second node, a second electrode connected to ground, and a gate connected to a third node;

a first switch comprising a first terminal connected to the first electrode of the fifth transistor, and a second terminal connected to the gate of the fifth transistor, the first switch being adapted to connect the fifth transistor like a diode to allow the second current to flow through the fifth transistor when closed; and a first capacitor adapted to supply a predetermined voltage to the gate of the fifth transistor enabling the second current to flow through the fifth transistor.

12. The light emitting display of claim 11, wherein the third transistor is adapted to turn on by the first switching signal when the second and fourth transistors are turned off, and the first switch is adapted to turn on by a second switching signal when the third transistor is turned on; and the third transistor is adapted to turn off by the first switching signal when the second and fourth transistors are turned on, and the first switch is adapted to turn off by the second switching signal when the third transistor is turned off.

13. The light emitting display of claim 11, further comprising:

a sixth transistor connected between the fifth transistor and ground, the sixth transistor being adapted to allow the second current to flow toward ground;

a second capacitor adapted to store a voltage to supply the voltage a gate of the sixth transistor enabling the second current to pass through the sixth transistor; and a second switch adapted to connect the sixth transistor like a diode in correspondence to the second switching signal.

14. The light emitting display of claim 12, the third transistor being adapted to be turned on when the second and fourth transistors are turned off by the first switching signal, and the first switch is adapted to be turned on by the second switching signal when the third transistor is turned on; and the third transistor is adapted to be turned off when the second and fourth transistors are turned on by the first switching signal, and the first switch is adapted to be turned off by the second switching signal when the third transistor is turned off.

15. The light emitting display of claim 1, wherein the data driving integrated circuit comprises:

a shift register part adapted to generate sampling signals in sequence;

a latch part adapted to store external data in correspondence to the sampling signals; and a voltage digital-analog converter adapted to generate a gradation voltage corresponding to the external data stored in the latch part.

* * * * *